US005743531A

United States Patent [19]

Rosa

[11] Patent Number: 5,743,531

[45] Date of Patent: Apr. 28, 1998

[54] MATHEMATICAL INVESTMENT GAME

[76] Inventor: Elsie Rosa, 235 E. 96th St., #3A, New York City, N.Y. 10128

[21] Appl. No.: 562,407

[22] Filed: Nov. 24, 1995

[51] Int. Cl.[6] ..... A63F 3/00

[52] U.S. Cl. ..... 273/278

[58] Field of Search ..... 273/236, 242, 273/243, 248, 249, 256, 278

[56] References Cited

U.S. PATENT DOCUMENTS

| | | | |
|---|---|---|---|
| 3,494,619 | 2/1970 | Biegonis | 273/256 |
| 4,025,075 | 5/1977 | Priska et al. | 273/278 |
| 4,040,629 | 8/1977 | Kelly | 273/278 |
| 4,162,075 | 7/1979 | Iannucci | 273/256 |
| 4,382,602 | 5/1983 | Cusick et al. | 273/256 |
| 4,394,017 | 7/1983 | Maloy | 273/256 X |
| 4,930,789 | 6/1990 | Harris et al. | 273/256 |
| 5,190,292 | 3/1993 | Perry | 273/256 |
| 5,228,698 | 7/1993 | Dubarry, Jr. | 273/256 |
| 5,261,672 | 11/1993 | Jordan | 273/256 |

FOREIGN PATENT DOCUMENTS

| | | | |
|---|---|---|---|
| 2201897 | 9/1988 | United Kingdom | 273/256 |

*Primary Examiner*—William E. Stoll

[57] ABSTRACT

A mathematical investment game comprising: a game board having a central region including a large circle divided into first, second, third and fourth equally sized quadrants, a spinner including a central pivot pin being rotatably coupled to the centerpoint of the circle, the quadrants including different colors and indicia, the game board including first, second, third and fourth corner regions located adjacent to correspondingly numbered quadrants of the circle, each corner region including a plurality of property squares, each property square including numerical indicia, the apparatus including rules instructing players how to play the game; and play money including a plurality of bills with varying denominations, the varying denominations being imprinted upon the bills as numerals, the numerals including 1, 5, 10, 20, 50, 100, 500, 1,000, 5,000 and 10,000.

7 Claims, 4 Drawing Sheets

MATHEMATICAL INVESTMENT GAME

BACKGROUND OF THE INVENTION

1. Field of the Invention

The present invention relates to a mathematical investment game and more particularly pertains to teaching players math and investment concepts while playing the game.

2. Description of the Prior Art

The use of educational games is known in the prior art. More specifically, educational games heretofore devised and utilized for the purpose of instructing players about an academic subject area while playing the games are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,102,339 to Parriera a mathematical education game.

U.S. Pat. No. 4,561,658 to Peterson discloses a math matching game.

U.S. Pat. No. 5,176,381 to Winters discloses a mathematical game apparatus and method.

Lastly, U.S. Pat. No. 4,932,668 to Stewart discloses a investment board game.

In this respect, the mathematical investment game according to the present invention substantially departs from the conventional concepts and designs of the prior art, and in doing so provides an apparatus primarily developed for the purpose of teaching players math and investment concepts while playing the game.

Therefore, it can be appreciated that there exists a continuing need for a new and improved mathematical investment game which can be used for teaching players math and investment concepts while playing the game. In this regard, the present invention substantially fulfills this need.

SUMMARY OF THE INVENTION

In view of the foregoing disadvantages inherent in the known types of educational games now present in the prior art, the present invention provides an improved mathematical investment game. As such, the general purpose of the present invention, which will be described subsequently in greater detail, is to provide a new and improved mathematical investment game and method which has all the advantages of the prior art and none of the disadvantages.

To attain this, the present invention essentially comprises a new and improved mathematical investment game comprising, in combination: a game board formed in a generally rectangular configuration with a first side edge, a second side edge, a front edge and a rear edge, the game board having a central region including a large circle divided into first, second, third and fourth equally sized quadrants, an arrow shaped spinner including a central pivot pin being rotatably coupled to the centerpoint of the circle, the first quadrant including the indicia GREEN imprinted therewithin, the indicia CENTRAL CITY #1 being imprinted upon the board outside the first quadrant of the circle, the second quadrant including the indicia YELLOW imprinted therewithin, the indicia HAMBERG CITY #2 being imprinted upon the board outside of the second quadrant of the circle, a third quadrant including the indicia RED imprinted thereupon, the indicia MORNING CITY #3 being imprinted upon the board outside the third quadrant of the circle, the fourth quadrant of the circle including the indicia BLUE imprinted therewithin, the indicia ICELAND CITY #4 being imprinted upon the board outside the fourth quadrant of the circle, the game board including first, second, third and fourth corner regions located adjacent to correspondingly numbered quadrants of the circle, each corner region including two columns of three property squares, each property square having indicia including # followed by a unique three digit numeral, each property square further having indicia including between two and three single numerals ranging between one and six, each numeral being followed by %; a hand held calculator formed in a generally rectangular configuration and including an angled upper surface with a key pad and a liquid crystal display; a plurality of color chips comprising green, yellow, red and blue color groupings; a numeric die having six sides and including between one and six dots on each side, a YES/NO die having three sides including the indicia YES and three sides including the indicia NO; play money including a plurality of bills with varying denominations, the varying denominations being imprinted upon the bills as numerals, the numerals including 1, 5, 10, 20, 50, 100, 500, 1,000, 5,000 and 10,000; a plurality of I.D. cards, each I.D. card having indicia including a property number and percentage rate corresponding to the indicia on a property square, each I.D. card having a rear surface including the indicia "SOLD" imprinted thereupon, a plurality of agreement sheets, each agreement sheet including a carbon copy attachment, a bag including the indicia LOTTO thereupon, a bag including the indicia INTEREST thereupon, a plurality of small cards, the small cards having indicia including lose 1–4%, gain 1–10%, try again, and pick a percentage free; and the game having rules indicating that the game commences with each player being assigned twenty thousand dollars in play money, each player initially spinning the arrow to randomly select a color quadrant, the color quadrant selected determining the corner region and color chip assigned to each player, the green chips being designated eight percent, the yellow chips seven percent, the red chips six percent and the blue chips five percent, after the initial selection of a color quadrant each player in turn spinning the arrow to randomly select a corner region for an individual turn, a player rolling the numeric die to select a property square in the selected corner region, the yes/no die then being rolled, a yes result requiring the player to purchase a percentage of the property, the properties being worth varying amounts, the amount to be paid being calculated by multiplying the property value by a determined percentage amount, the object of the game being to sell at least four properties, the player with the most money after all of the players have sold at least four properties being deemed the winner of the game.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved mathematical investment game which has all of the advantages of the prior art educational games and none of the disadvantages.

It is another object of the present invention to provide a new and improved mathematical investment game which may be easily and efficiently manufactured and marketed.

It is further object of the present invention to provide a new and improved mathematical investment game which is of durable and reliable constructions.

An even further object of the present invention is to provide a new and improved mathematical investment game which is susceptible of a low cost of manufacture with regard to both materials and labor, and which accordingly is then susceptible of low prices of sale to the consuming public, thereby making such mathematical investment game economically available to the buying public.

Still yet another object of the present invention is to provide a new and improved mathematical investment game which provides in the apparatuses and methods of the prior art some of the advantages thereof, while simultaneously overcoming some of the disadvantages normally associated therewith.

Still another object of the present invention is to teach players math and investment concepts while playing the game.

Lastly, it is an object of the present invention to provide a new and improved mathematical investment game comprising: a game board having a central region including a large circle divided into first, second, third and fourth equally sized quadrants, an spinner including a central pivot pin being rotatably coupled to the centerpoint of the circle, the quadrants including different colors and indicia, the game board including first, second, third and fourth corner regions located adjacent to correspondingly numbered quadrants of the circle, each corner region including a plurality of property squares, each property square including numerical indicia, the apparatus including rules instructing players how to play the game; and play money including a plurality of bills with varying denominations, the varying denominations being imprinted upon the bills as numerals, the numerals including 1, 5, 10, 20, 50, 100, 500, 1,000, 5,000 and 10,000.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
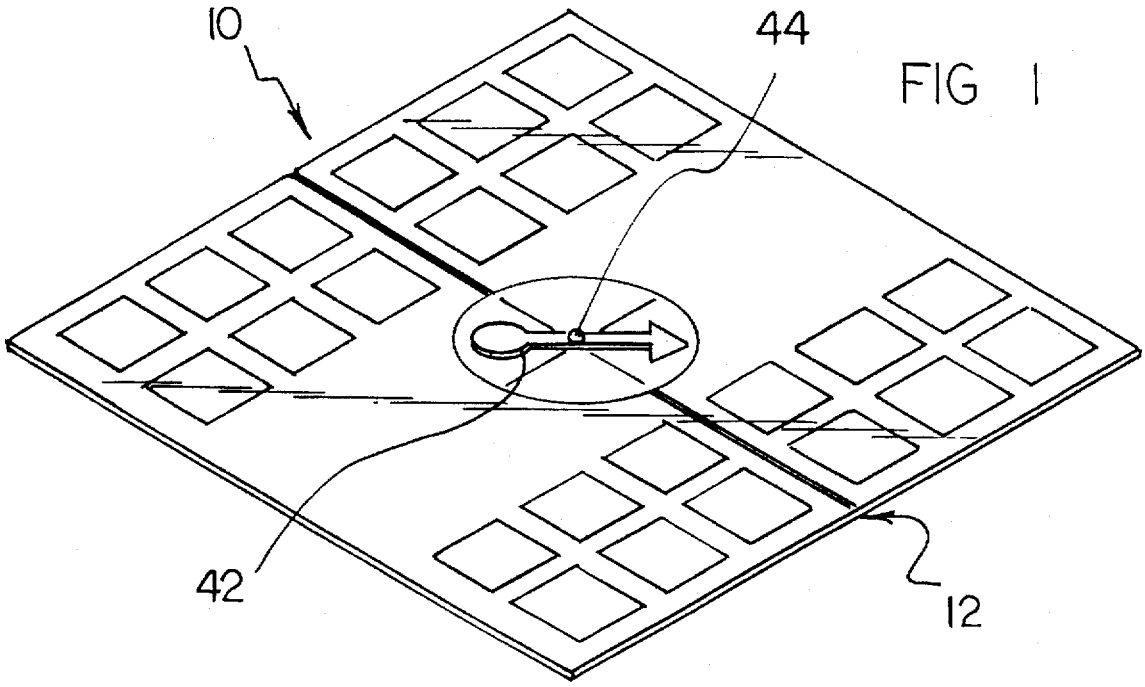
FIG. 1 is a perspective view of the preferred embodiment of the mathematical investment game constructed in accordance with the principles of the present invention.

With reference now to the drawings, and in particular to FIG. 1 thereof, the preferred embodiment of the new and improved mathematical investment game embodying the principles and concepts of the present invention and generally designated by the reference numeral 10 will be described.

The present invention, the mathematical investment game 10 is comprised of a plurality of components. Such components in their broadest context include a game board 12, a hand held calculator 14, a plurality of color chips 16, a numeric die 18, and a YES/NO die 20. Such components are individually configured and correlated with respect to each other so as to attain the desired objective.

Figure 5:
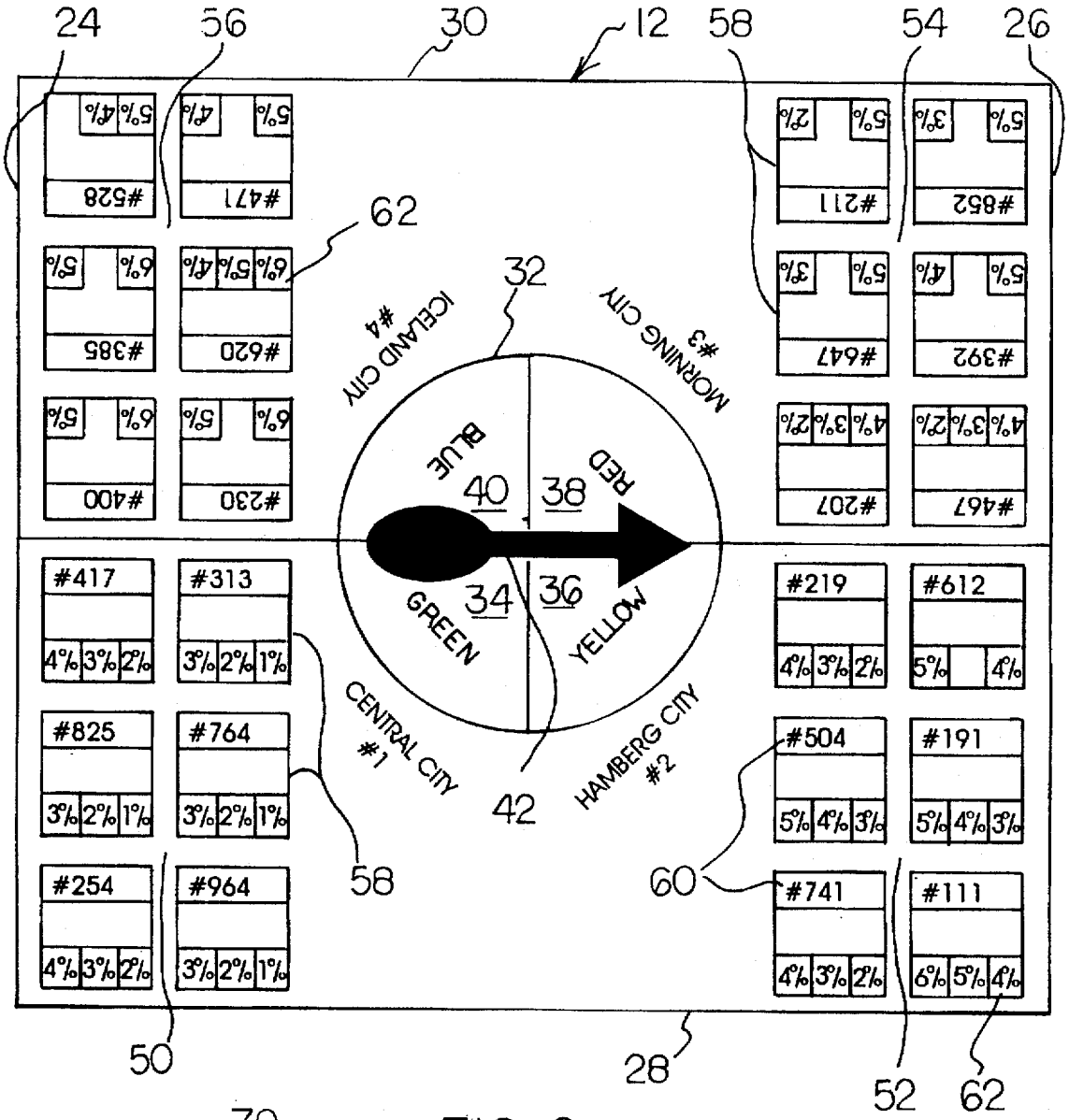
FIG. 5 is a top perspective view of the game board of the apparatus illustrating the percentage designations attributable to each property number.
Figure 6:
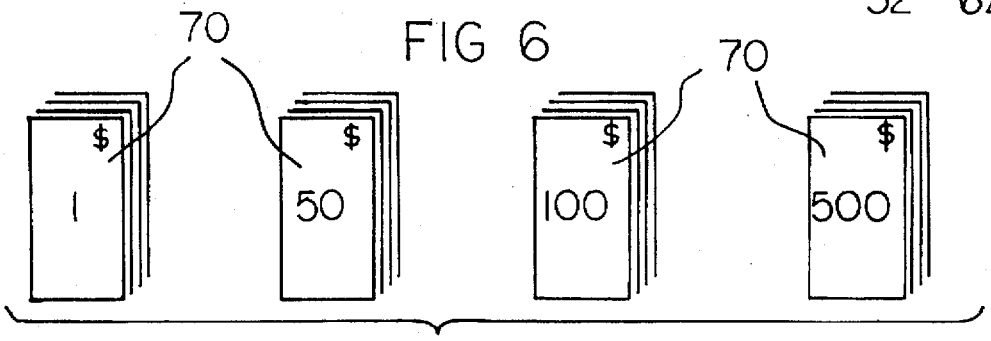
FIG. 6 is a perspective view of the play money of the apparatus.
Figure 7:
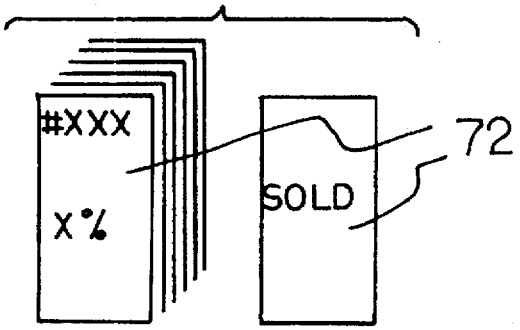
FIG. 7 is a perspective view of the I.D. cards of the apparatus.
Figure 8:
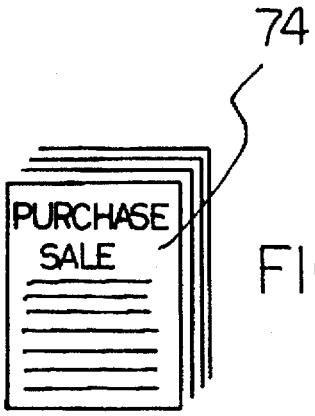
FIG. 8 is a perspective view of the purchase/sale agreements of the apparatus.
Figure 9:
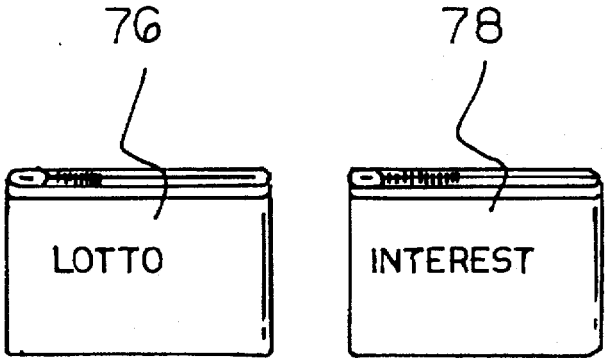
FIG. 9 is a perspective view of the lotto and interest bags of the apparatus.
Figure 10:
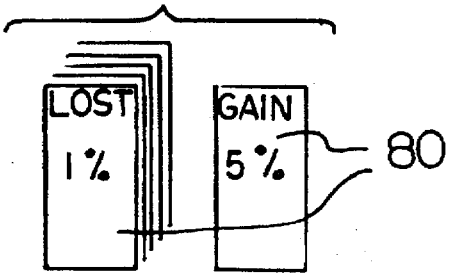
FIG. 10 is a perspective view of the interest cards of the apparatus.
Figure 11:
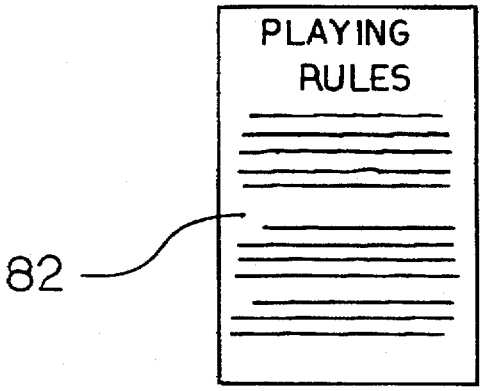
FIG. 11 is a perspective view of the playing rules of the apparatus.

More specifically, the game board 12 is formed in a generally rectangular configuration with a first side edge 24, a second side edge 26, a front edge 28 and a rear edge 30. The board is fabricated of cardboard in the preferred embodiment. In alternative embodiments the board is fabricated of plastic or other synthetic materials. The front and rear edges of the board are 16 inches in length. The side edges of the board are 14 inches in length. The game board has a central region which includes a large circle 32 divided into first 34, second 36, third 38 and fourth 40 equally sized quadrants. Note FIGS. 1 and 5.

An arrow shaped spinner 42 includes a central pivot pin 44 that is rotatably coupled to the centerpoint of the circle. In an operative orientation a player hits the spinner with a finger causing the spinner to rotate. The position of the arrowhead upon cessation of rotation determines the randomly selected quadrant and corresponding color chip assigned to the user. The player then rolls the numerical die to select a property from that quadrant of the board. The first quadrant 34 includes the indicia GREEN imprinted within it. The indicia CENTRAL CITY #1 is imprinted upon the board outside the first quadrant of the circle. The second quadrant 36 includes the indicia YELLOW imprinted within it. The indicia HAMBERG CITY #2 is imprinted upon the board outside of the second quadrant of the circle. The third quadrant 38 includes the indicia RED imprinted within it. The indicia MORNING CITY #3 is imprinted upon the board outside the third quadrant of the circle. The fourth quadrant 40 of the circle includes the indicia BLUE imprinted within it. The indicia ICELAND CITY #4 is imprinted upon the board outside the fourth quadrant of the circle. Note FIG. 5. The game board includes first 50, second 52, third 54 and fourth 56 corner regions located adjacent to corresponding quadrants of the circle. Each corner region includes two columns of three property squares 58. Each property square has indicia including # followed by a unique three digit numeral 60 to designates the property number. Below is an ID NUMBER LISTING indicating the property names associated with each property number.

| ID NUMBER LISTING | |
|---|---|
| 1. 111 | Sunset Motel |
| 2. 191 | Wheat Plantation |
| 3. 207 | Morning City Bank |
| 4. 211 | International Exchange |
| 5. 219 | Dairy Farm |
| 6. 230 | Soda Factory Import |
| 7. 254 | Riteway Airline |
| 8. 313 | Tourist Inn |
| 9. 385 | Ice Skating Representation |
| 10. 392 | Candy Factory |
| 11. 400 | Iceland National Bank |
| 12. 417 | Orange Factory |
| 13. 467 | Worldwide Agency |
| 14. 471 | Iceland Motel |
| 15. 504 | Hamberg's Carnival |
| 16. 528 | Sporting Goods |
| 17. 612 | Hamberg Bus Terminal |
| 18. 620 | Flamingo Supermarket |
| 19. 647 | Rose's Antiques |
| 20. 741 | Hamberg's Market Place |
| 21. 764 | Moonlight Cafe |
| 22. 825 | Art 'n' Fashion Dept. |
| 23. 852 | Moraco Hotel |
| 24. 964 | Mini Mall Plaza |

Each property square further has indicia including between two and three single numerals between one and six. Each single numeral is followed by "%" 62 and indicates the percentages assigned to each property. Note FIG. 5.

Figure 3:
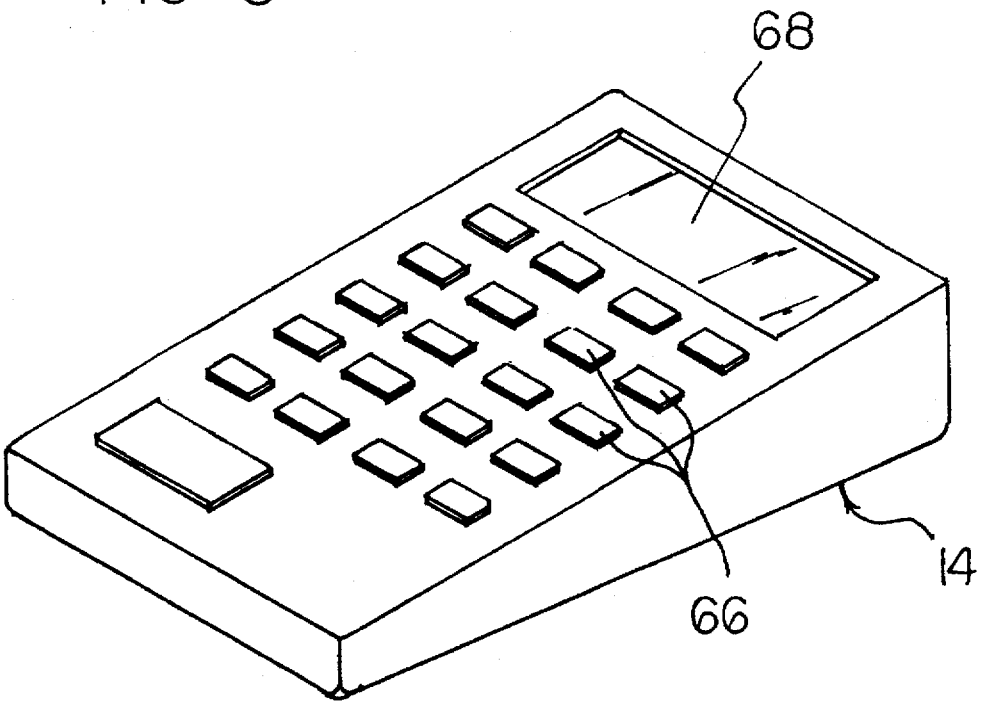
FIG. 3 is a perspective view of the hand held calculator of the apparatus.
Figure 4:
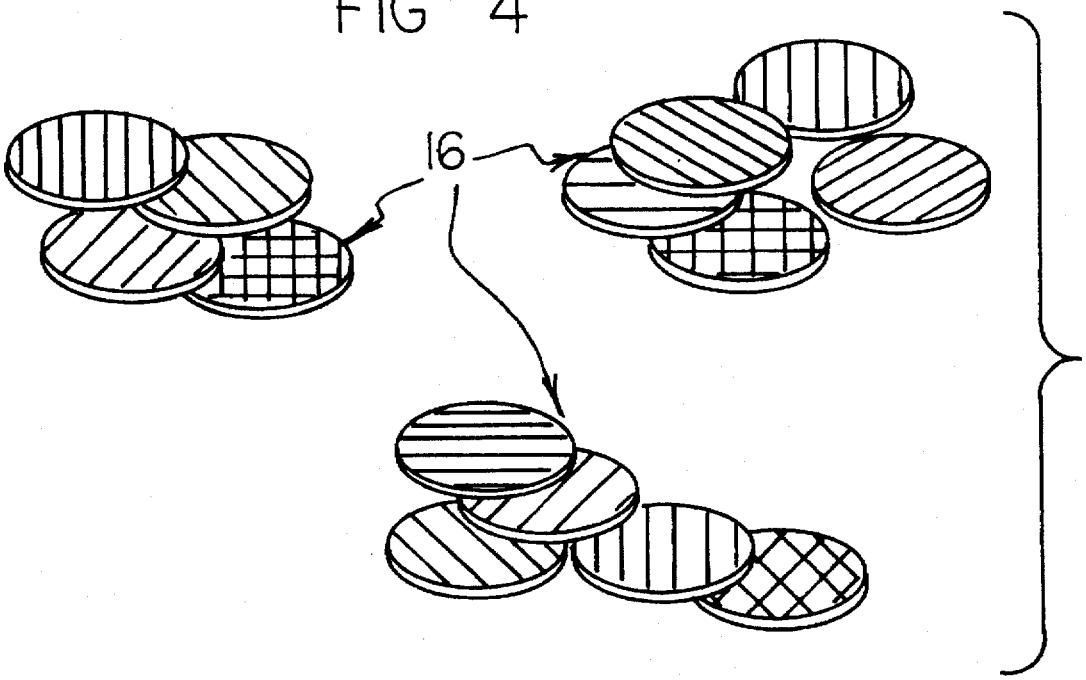
FIG. 4 is a perspective view of the playing chips of the apparatus.

A hand held calculator 14 is formed in a generally rectangular configuration and includes an angled upper surface with a key pad 66 and a liquid crystal display 68. The calculator is utilized to enable players to calculate the various amounts which must be paid to other players and/or brokers during play of the game. Use of the calculator represents a major part of the utility of the game because it teaches player to quickly and efficiently utilize a calculator to determine dollar amounts based on various percentages. Scrap paper is generally utilized with the game to help calculate the dollar amounts. Note FIG. 3.

A plurality of color chips 16 are comprised of green, yellow, red and blue color groupings. The chips are formed in a planar circular configuration. The green chips are assigned a value of 8 percent, the yellow chips 7 percent, the red chips 6 percent, and the blue chips 5 percent. Note FIG. 3.

Figure 2:
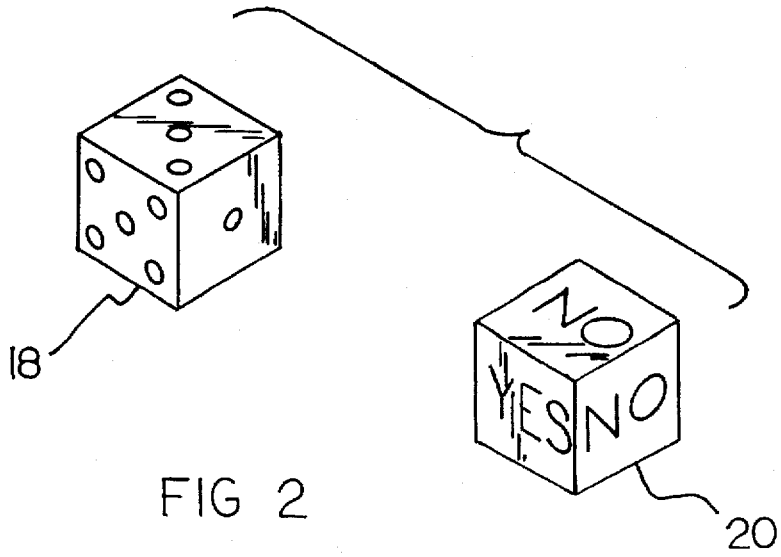
FIG. 2 is a perspective view of the numerical die and yes/no die of the apparatus.

A numeric die 18 has six sides and includes between one and six dots on each side. The six-sided die is utilized to select a property square after a city designation has been assigned to a player. A YES/NO 20 die has three sides which include the indicia YES and three sides which include the indicia NO. Note FIG. 2.

The game also includes a plurality of bills 70 with varying denominations. The varying denominations are imprinted upon the bills as numerals. The numerals include 1, 5, 10, 20, 50, 100, 500, 1,000, 5,000 and 10,000. The game includes $400,000 in play money.

A plurality of I.D. cards 72 are included with the apparatus. There are between two and three I.D. cards corresponding to each property square, one I.D. card for each percentage. Each I.D. card has indicia including a property number and percentage rate corresponding to the indicia on an individual property square. Each I.D. card has a rear surface including the indicia "SOLD" imprinted thereupon. After a sale has been made, the I.D. card corresponding to the property square and percentage sold is positioned adjacent to the game board with its rear surface facing upward. A plurality of agreement sheets 74 are included with the game. The agreement sheets include the indicia PURCHASE SALE IMPRINTED UPON THEM. Each agreement sheet has a carbon copy attachment. A first bag 76 includes the indicia LOTTO imprinted upon it. A second bag 78 includes the indicia INTEREST imprinted upon it. A plurality of small cards 80 which have indicia including lose 1–4%, gain 1–10%, try again, and pick a percentage free, are positioned within the interest bag.

The game includes playing rules 82. The game is designed to be played by between two and four players, from age ten to adult. The game requires participants to use a wide range of mathematical skills including percentage calculation, subtraction and multiplication. The game commences with each player receiving twenty thousand dollars in play money. Each player receives the following bills at the start of the game: 1-10,000 bill, 1-5,000 bill, 1-1,000 bill, 1-500 bill. The players may then convert their bills to smaller denominations. Each player is required to contribute $25 to the petty cash fund at the beginning of the game. A broker is then nominated. If a player accepts the nomination, they are required to contribute $50 to the petty cash fund. If a player refuses the nomination, they are still required to contribute $15 to the petty cash fund. Each player initially spins the arrow to randomly select a color quadrant. The color quadrant selected determines the corner region, city and color chip to be assigned to each player. The green chips are designated eight percent, the yellow chips seven percent, the red chips six percent and the blue chips five percent.

After the initial selection of a color quadrant, each player in turn spins the arrow to randomly select a corner region for an individual turn. A player rolls the numeric die to select a property square in the selected corner region. The property squares are counted from the top of the left column, to the bottom of the left column, to the top of the right column, to the bottom of the right column. The yes/no die is then rolled. A "YES" result requires a player to purchase a percentage of the property. A "NO" result means that a player does not have to buy the percentage, but instead contributes $15 to the petty cash fund. The properties are worth varying amounts. The amount to be paid is calculated by multiplying the property value by a determined percentage amount. The corresponding value for each property is summarized below:

| PROPERTY DOLLAR AMOUNT LISTING: | |
|---|---|
| $14,000 | 111 Sunset Motel |
| $17,000 | 191 Wheat Plantation |
| $12,000 | 207 Morning City Bank |
| $5,000 | 211 International Exchange |
| $22,000 | 219 Dairy Farm |
| $15,000 | 230 Soda Factory Import |
| $30,000 | 254 Riteway Airline |
| $33,000 | 313 Tourist Inn |
| $11,000 | 385 Ice Skating Representation |
| $9,000 | 392 Candy Factory |
| $14,000 | 400 Iceland National Bank |
| $35,000 | 417 Orange Factory |
| $12,000 | 467 Worldwide Agency |
| $10,000 | 471 Iceland Motel |
| $18,000 | 504 Hamberg's Carnival |
| $10,000 | 528 Sporting Goods |
| $18,000 | 612 Hamberg Bus Terminal |
| $13,000 | 620 Flamingo Supermarket |
| $7,000 | 647 Rose's Antiques |
| $15,000 | 741 Hamberg's Market Place |
| $30,000 | 764 Moonlight Cafe |
| $33,000 | 825 Art 'n' Fashion Dept. |
| $7,000 | 852 Moraco Hotel |
| $28,000 | 964 Mini Mall Plaza |

When a player invests in a property he may use the chip which was received at the beginning of the game to obtain a discount on the purchase. The discount is equal to half of the chip percentage. For example, if you have an 8% chip, your discount will be 4%. Note the summary below:

| WHOLE | HALF |
|---|---|
| 8% = | 4% |
| 7% = | 3.5% |
| 6% = | 3% |
| 5% = | 2.5% |

After selling a property the broker throws a lotto. A lotto is performed by the broker by taking the lotto bag and placing four differently colored chips in it. The seller of the property randomly selects a chip from the bag. If the seller's color is chosen, he receives the percentage amount corresponding to the seller's chip color, multiplied by the property amount.

For example:

| | |
|---|---|
| Flamingo supermarket | $13,000 (property amount) |
| multiplied by | 7% (yellow chip) |
| receive | $910 |

If the seller's color is not chosen, he receives a percentage amount imprinted on the property square. For example: The first purchase of Dairy Farm, property No. 219, would be calculated as follows:

| | |
|---|---|
| Property amount | $22,000 |
| Investment percentage | 4% |
| Discount percentage | 3.5% |
| Buyer pays | $849 |

The second purchase of Dairy Farm, property No. 219, would be calculated as follows:

| | |
|---|---|
| Property amount | $22,000 |
| Investment percentage | 3% |
| Discount percentage | 3.5% |
| Buyer pays | $636 |

The third purchase of Dairy Farm, property No. 219, would be calculated as follows:

| | |
|---|---|
| Property amount | $22,000 |
| Investment percentage | 2% |
| Discount percentage | 3.5% |
| Buyer pays | $424 |

Every time a player decides to invest in another player's property, an agreement sheet is filled out. Both the buyer and seller receive a copy of the agreement sheet.

Below is an example illustrating how a chip discount would be calculated if a player chose to utilize his discount chip in a particular purchase. For purposes of this example it is assumed that the current purchase is the "first purchase" for Dairy Farm, property No. 219, and the purchaser possesses a yellow chip. Note that all calculated amounts are rounded to the nearest dollar.

| | | |
|---|---|---|
| | $22,000 | (property amount) |
| × | 4% | (property percentage) |
| | $880 | |
| × | 3.5% | (discount percentage) |
| | 30.80 = $31 | |
| | $880 | |
| − | 31 | |
| | $849 | (purchaser pays this amount) |

The first player to sell two properties receives the petty cash funds. The first player to sell a property to the broker gets a bigger bargain. The broker will pay seller for the full property amount.

When a seller sells a percentage of a property to another player, and then later sells it to the broker, the broker will throw a lotto to find out how much interest the buyer wins. The buyer is paid by the seller. In this instance the lotto is conducted by a player picking a small card from the interest bag. The small cards include indicia stating lose 1–4%, gain 1–10%, try again and pick a percentage free.

The ultimate object of the game is to sell at least four properties. The player with the most money after all of the players have sold at least four properties is deemed the winner of the game.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved mathematical investment game comprising, in combination:

a game board formed in a generally rectangular configuration with a first side edge, a second side edge, a front edge and a rear edge, the game board having a central region including a large circle divided into first, second, third and fourth equally sized quadrants, an arrow shaped spinner including a central pivot pin being rotatably coupled to the centerpoint of the circle, the first quadrant including the indicia GREEN imprinted therewithin, the indicia CENTRAL CITY #1 being imprinted upon the board outside the first quadrant of the circle, the second quadrant including the indicia YELLOW imprinted therewithin, the indicia HAMBERG CITY #2 being imprinted upon the board outside of the second quadrant of the circle, a third quadrant including the indicia RED imprinted thereupon, the indicia MORNING CITY #3 being imprinted upon the board outside the third quadrant of the circle, the fourth quadrant of the circle including the indicia BLUE imprinted therewithin, the indicia ICELAND CITY #4 being imprinted upon the board outside the fourth quadrant of the circle, the game board including first, second, third and fourth corner regions located adjacent to correspondingly numbered quadrants of the circle, each corner region including two columns of three property squares, each property square having indicia including # followed by a unique three digit numeral, each property square further having indicia including between two and three single numerals ranging between one and six, each numeral being followed by %;

a hand held calculator formed in a generally rectangular configuration and including an angled upper surface with a key pad and a liquid crystal display;

a plurality of color chips comprising green, yellow, red and blue color groupings;

a numeric die having six sides and including between one and six dots on each side, a YES/NO die having three sides including the indicia YES and three sides including the indicia NO;

play money including a plurality of bills with varying denominations, the varying denominations being imprinted upon the bills as numerals, the numerals including 1, 5, 10, 20, 50, 100, 500, 1,000, 5,000 and 10,000;

a plurality of I.D. cards, each I.D. card having indicia including a property number and percentage rate corresponding to the indicia on a property square, each I.D. card having a rear surface including the indicia SOLD imprinted thereupon, a plurality of agreement sheets, each agreement sheet including a carbon copy attachment, a bag including the indicia LOTTO thereupon, a bag including the indicia INTEREST thereupon, a plurality of small cards, the small cards having indicia including lose 1–4%, gain 1–10%, try again, and pick a percentage free; and the game having rules indicating that the game commences with each player being assigned twenty thousand dollars in play money, each player initially spinning the arrow to randomly select a color quadrant, the color quadrant selected determining the corner region and color chip assigned to each player, the green chips being designated eight percent, the yellow chips seven percent, the red chips six percent and the blue chips five percent, after the initial selection of a color quadrant each player in turn spinning the arrow to randomly select a corner region for an individual turn, a player rolling the numeric die to select a property square in the selected corner region, the yes/no die then being rolled, a yes result requiring the player to purchase a percentage of the property, the properties being worth varying amounts, the amount to be paid being calculated by multiplying the property value by a determined percentage amount, the object of the game being to sell at least four properties, the player with the most money after all of the players have sold at least four properties being deemed the winner of the game.

2. A mathematical investment game comprising:

a game board having a central region including a large circle divided into first, second, third and fourth equally sized quadrants, a spinner including a central pivot pin being rotatably coupled to the centerpoint of the circle, the quadrants including different colors and indicia, the game board including first, second, third and fourth corner regions located adjacent to correspondingly numbered quadrants of the circle, each corner region including a plurality of property squares, each property square including numerical indicia, the apparatus including rules instructing players how to play the game; and play money including a plurality of bills with varying denominations, the varying denominations being imprinted upon the bills as numerals, the numerals including 1, 5, 10, 20, 50, 100, 500, 1,000, 5,000 and 10,000.

3. The mathematical investment game as set forth in claim 2 wherein the first quadrant includes the indicia GREEN imprinted therewithin, the indicia CENTRAL CITY #1 being imprinted upon the board outside the first quadrant of the circle, the second quadrant including the indicia YELLOW imprinted therewithin, the indicia HAMBERG CITY #2 being imprinted upon the board outside of the second quadrant of the circle, a third quadrant including the indicia RED imprinted thereupon, the indicia MORNING CITY #3 being imprinted upon the board outside the third quadrant of the circle, the fourth quadrant of the circle including the indicia BLUE imprinted therewithin the indicia ICELAND CITY #4 being imprinted upon the board outside the fourth quadrant of the circle.

4. The mathematical investment game as set forth in claim 3 and further including:

a plurality of color chips comprising green, yellow, red and blue color groupings.

5. The mathematical investment game as set forth in claim 2 and further including:

a numeric die having six sides and including between one and six dots on each side, a YES/NO die having three sides including the indicia YES and three sides including the indicia NO.

6. The mathematical investment game as set forth in claim 2 and further including:

a plurality of I.D. cards, each I.D. card having indicia including a property number and percentage rate corresponding to the indicia on a property square, each I.D. card having a rear surface including the indicia "SOLD" imprinted thereupon, a plurality of agreement sheets, each agreement sheet including a carbon copy attachment, a bag including the indicia LOTTO thereupon, a bag including the indicia INTEREST thereupon, a plurality of small cards, the small cards having indicia including lose 1 –4%, gain 1 –10%, try again, and pick a percentage free.

7. The mathematical investment game as set forth in claim 2 and further including:

a hand held calculator formed in a generally rectangular configuration and including an angled upper surface with a key pad and a liquid crystal display.

* * * * *